US006761406B2

(12) United States Patent
Kinoshita et al.

(10) Patent No.: US 6,761,406 B2
(45) Date of Patent: Jul. 13, 2004

(54) CHAIR FITTED WITH AN UPHOLSTERY MEMBER

(75) Inventors: Yojiro Kinoshita, Osaka (JP); Nobuyuki Ueda, Osaka (JP)

(73) Assignee: Kokuyo Co., Ltd. (JP)

( * ) Notice: Subject to any disclaimer, the term of this patent is extended or adjusted under 35 U.S.C. 154(b) by 0 days.

(21) Appl. No.: 10/130,743

(22) PCT Filed: Oct. 9, 2001

(86) PCT No.: PCT/JP01/08865

§ 371 (c)(1),
(2), (4) Date: Aug. 14, 2002

(87) PCT Pub. No.: WO02/32267

PCT Pub. Date: Apr. 25, 2002

(65) Prior Publication Data

US 2003/0107252 A1 Jun. 12, 2003

(30) Foreign Application Priority Data

Oct. 16, 2000 (JP) ..... 2000-314995
Oct. 16, 2000 (JP) ..... 2000-315769

(51) Int. Cl.[7] ..... A47C 3/00
(52) U.S. Cl. ..... 297/296; 297/301.3
(58) Field of Search ..... 297/301.3, 301.2, 297/301.1, 298, 296, 452.15, 452.18, 452.56, 297, 452.13, 284.2

(56) References Cited

U.S. PATENT DOCUMENTS 293,813 A * 2/1884 St. John ..... 297/63
1,955,687 A * 4/1934 Scott
2,020,028 A * 11/1935 Hanauer
2,109,697 A * 3/1938 Hanauer
2,711,785 A * 6/1955 Moller
3,110,519 A * 11/1963 Chernivsky
3,235,306 A * 2/1966 Chernivsky
4,251,106 A * 2/1981 Gilbert
4,522,444 A * 6/1985 Pollock
4,673,211 A * 6/1987 Hoffman
4,976,494 A * 12/1990 Polley
5,100,201 A * 3/1992 Becker et al. ..... 297/301.3
5,195,804 A * 3/1993 Stolle et al.
5,385,388 A * 1/1995 Faiks et al.
5,904,397 A * 5/1999 Fismen
5,997,094 A * 12/1999 Cvek

FOREIGN PATENT DOCUMENTS

| | | |
|---|---|---|
| JP | 2-257910 A | 10/1990 |
| JP | 4-357907 A | 12/1992 |
| JP | 7-184741 A | 7/1995 |
| JP | 8-24071 A | 1/1996 |
| JP | 10-155589 A | 6/1998 |

* cited by examiner

*Primary Examiner*—Milton Nelson, Jr.
(74) *Attorney, Agent, or Firm*—Banner & Witcoff Ltd.

(57) ABSTRACT

In a chair 1 having an upholstery member 7 fitted on a backrest portion or seat plate 4 serving as a portion adapted to contact a human body, upright portions 41 and elastic pieces 8 allowing their deflection in the direction in which the load of a human body contacting the chair works are provided and the upholstery member 7 is placed over the upright portions 41 and elastic pieces 8 so that the contacting portion of the seat portion or backrest portion is imparted with elasticity to ensure a better sitting comfort even if the upholstery member 7 lacks elasticity.

17 Claims, 8 Drawing Sheets

CHAIR FITTED WITH AN UPHOLSTERY MEMBER

CROSS REFERENCE TO RELATED APPLICATIONS

This is a U.S. National Phase Application under 35 U.S.C. §371 and applicant herewith claims the benefit of priority of PCT/JP01/08865 filed Oct. 9, 2001, which was published Under PCT Article 21(2) in Japanese, which claims priority to Japanese Application Nos. P2000-314995, filed Oct. 16, 2000 and P2000-315769, filed Oct. 16, 2000, the entire contents of which are incorporated herein by reference.

TECHNICAL FIELD

The present invention relates to chair structures and, more particularly, to chair structures made more comfortable to sit.

BACKGROUND ART

Presently, there exist chairs generally having a backrest or seat portion provided with cloth to be used at offices, campsites or the like. Such a chair is constructed by using a metal pipe frame to form an outer edge of the backrest or seat portion and sewing cloth directly on the frame.

With such a pipe frame directly attached with cloth, however, sitting comfort of the chair is subject to the elastic force of the cloth. Accordingly, use of hard cloth to impart the backrest or seat portion with a certain strength raises a problem that the sitting comfort of the chair becomes worse due to a lowered elastic force in the direction against which the back of a sitting person leans.

Further, since such a chair comprises a pipe frame or a wood frame to which cloth is directed attached, the chair involves another problem that a steep step is defined at the boundary between the pipe frame or wood frame and the cloth when a person sits on the chair and, hence, such a step gives the sitting person an uncomfortable feeling.

The present invention has been made in view of the foregoing problem, and it is an object of the present invention to provide a chair using an upholstery member in which a contacting portion of a seat or backrest portion is imparted with elasticity to offer better sitting comfort.

It is another object of the present invention to provide a chair offering a better contact feeling at around a portion attached with an upholstery member.

DISCLOSURE OF INVENTION

Accordingly, the present invention provides a chair fitted with an upholstery member in a portion adapted to contact a human body, wherein: an elastic member is provided which allows a deflection in a direction in which a load imposed by the human body contacting the chair works; and the upholstery member is mounted over the elastic member.

The construction in which the upholstery member is mounted over the elastic member allowing a deflection in the load working direction makes it possible to have the chair offer a soft sitting comfort by virtue of the elastic force resulting from the deflection of the elastic member even if the elastic force of the upholstery member is small.

Such an elastic member may be disposed in a seat portion as well as in a backrest portion. The method of mounting the upholstery member over the elastic member may include putting the upholstery member over the elastic member or wrapping the elastic member with the upholstery member.

In such an invention, the elastic member preferably has a fixed end on one side and a free end on other side. With this feature, an elastically restoring force corresponding to the amount of deflection can be gradually varied from the fixed end side of the elastic member thereby offering a smooth sitting comfort.

Particularly where such an elastic member is disposed in a backrest portion, a central portion of the backrest portion can deflect when a person sits on the chair, and with this deflection the head of the sitting person is raised forward about the shoulder portion of the backrest serving as a fulcrum thereby making it possible to direct the eyes of the sitting person at a working area on a desk or the like.

Further, if the free end side of the elastic member is curved toward the direction in which the load imposed by the sitting person works, the upholstery member can deflect smoothly along the curved portion of the elastic member thereby lessening uncomfortable feeling that is given by a portion contacting the human body.

In such a chair, it is possible to attach the elastic member in a manner to press the upholstery member toward the side contacting the human body (i.e., in the direction opposite to the load working direction). With this feature, the upholstery member mounted over the elastic member is pressed from the inside and, hence, wrinkles or the like of the upholstery member can be eliminated.

When such an invention is applied to a chair capable of inclining an upper portion of the backrest portion rearwardly, better sitting comfort can be ensured by the upholstery member, while, even if only the upper portion of the backrest portion is inclined rearwardly, expansion and contraction of the upholstery member due to the rearward inclination can be absorbed by the elastic member deflecting.

According to an invention for attaining the other object, there is provided a chair fitted with an upholstery member disposed in a portion adapted to contact a human body and attached to a frame, wherein: the frame is formed with an escape portion which allows the upholstery member to gradually align with the frame from an attached end of the upholstery member when a load is imposed on the upholstery member.

Since the escape portion allowing the upholstery member to gradually align with the frame is provided, a sharp bend of the upholstery member will not occur and, hence, uncomfortable feeling given by contact with a portion around this bend can be lessened, while at the same time the upholstery member can be prevented from wearing. It is sufficient to provide a curved or inclined portion adjusted to the build and weight of a prospective sitting person. In this case, it is possible to reduce portions contacting the frame as much as possible if a frame formed with such an escape portion is provided at four corners of a human body contacting portion such as the backrest portion or the like.

Preferably, the chair fitted with such an upholstery member comprises a cantilever elastic member attached to the chair, the upholstery member being placed thereover, and an escape space provided on a side allowing deflection of the elastic member, the escape space being widened from the fixed end side to the free end side of the elastic member.

Specifically, in the case where cloth or the like is attached to the seat or backrest portion forming a human body contacting portion, the elastic member is first attached with its one end made free and the other end fixed and then the cloth or the like is placed over the elastic member. In this process the escape space extending from the fixed end to the free end of the elastic member is defined for allowing deflection. With this feature, if the elastic member is composed of a highly deflectable material for example, the elastic member deforms within the escape space, so that the portion contacting the human body will not give an uncomfortable feeling to the sitting person.

If a frame having a curved portion aligning with deflection of the elastic member on the deflection allowing side is provided, the elastic member can be aligned with the curved portion even if the elastic member deflects largely, whereby the portion contacting the human body can be imparted a smooth touch, while at the same time the elastic member can be prevented from deteriorating due to its deflection.

BEST MODE FOR CARRYING OUT THE INVENTION

Hereinafter, the present invention will be described by way of embodiments shown in the attached drawings.

(First Embodiment)

Figure 1:
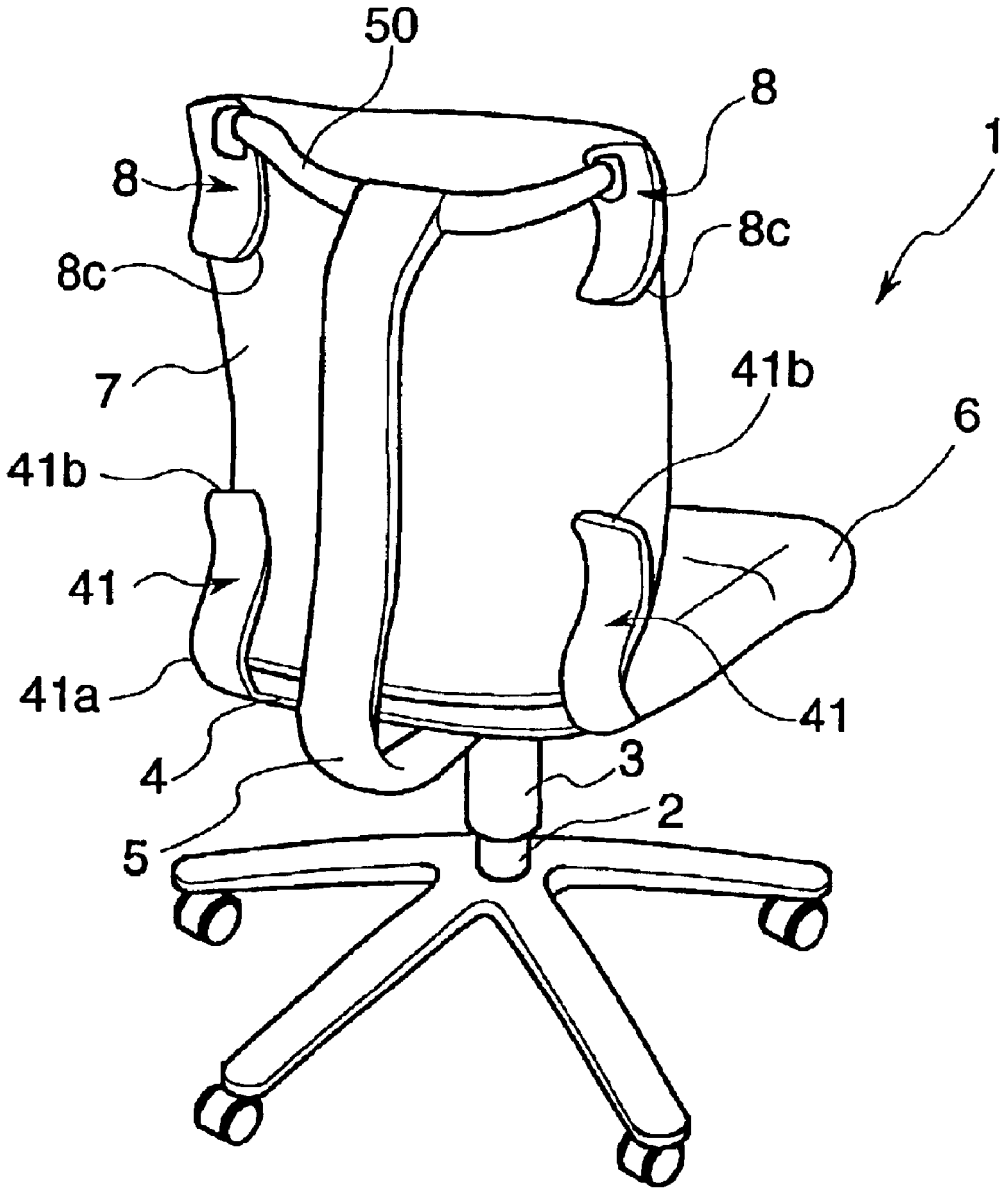
FIG. 1 is a rear perspective view showing a chair according to a first embodiment of the present invention.
Figure 2:
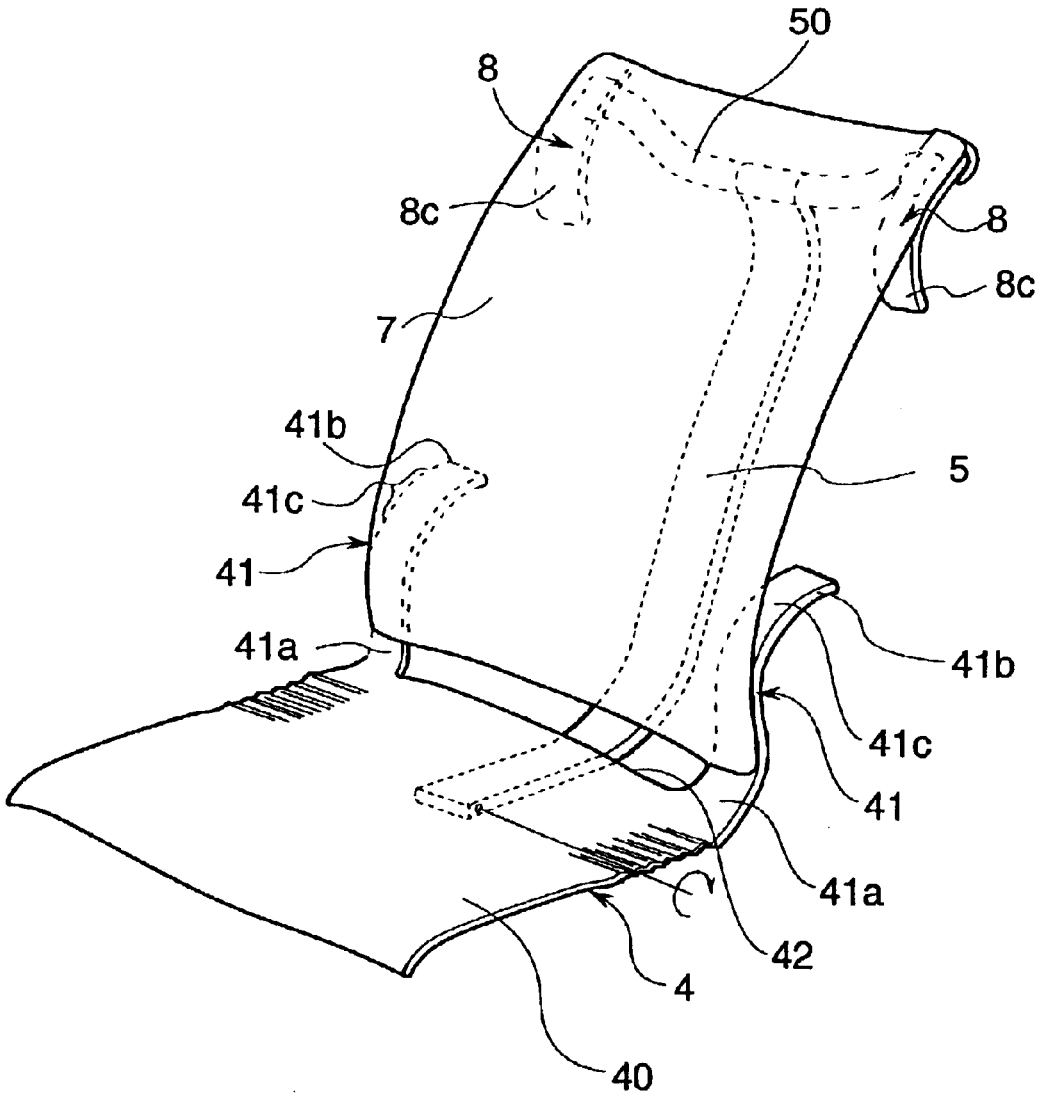
FIG. 2 is a front perspective view showing an upper portion of a seat plate of the chair according to the same embodiment.

Hereinafter, the first embodiment of the present invention will be described with reference to the drawings. FIG. 1 is a rear perspective view showing a chair 1 according to one embodiment of the present invention, and FIG. 2 illustrates only an upper portion of a seat plate 4 of this chair 1 in a state where a seat cushion 6 is removed.

The chair 1 comprises a support base 3 mounted on a base leg 2, and the seat plate 4 and a back support pillar 3 both mounted on the support base 3, and further comprises the seat cushion 6 mounted on the seat plate 4 and an upholstery member 7 provided in a backrest portion.

The support base 3, which is constructed of an aluminum member, has a lower side rotatably mounted on the base leg 2, an upper portion fitted with the seat plate 4, and a rear portion fitted with the back support pillar 5.

The seat plate 4 mounted on the support the base 3 is formed by processing resin or the like and comprises on its upper side a seat cushion mounting portion 40 for mounting the seat cushion 6 or the like thereon and an upright portion 41 extending continuously from a rear portion of the seat cushion mounting portion 40. The seat cushion mounting portion 40 is secured at its substantially central portion to the support base 3 using a fixing mechanism not shown. The seat cushion mounting portion 40 has a front edge side in a downwardly curved configuration to prevent the back side of the knees of a sitting person from abutting the front edge thereof.

Leaf-like upright portions 41 serving as elastic members attached to the right and left ends of the rear edge of the seat cushion mounting portion 40 are bent upwardly from the right and left ends of the rear edge of the seat cushion mounting portion 40, thereby defining a recess 42 in a lower central portion of the backrest portion to prevent the backbone or ischium of the sitting person from abutting the recess 42. The upright portions 41 each have a free end 41*b* that is capable of deflecting rearward about its bent portion 41*a* forming a fixed end. Each upright portion 41 further has a rearwardly curved portion 41*c* adjacent the upper end thereof for the upholstery member 7 to become aligned with the curved portion 41*c* when a person sits on the chair.

Reference numeral 5 designates the back support pillar forming part of the backrest portion. The back support pillar 5 has a lower end rotatably attached to the support base 3 and is upwardly bent from a central portion of the underside of the rear edge of the seat plate 4 and upwardly extends centrally of the space defined between and behind the right and left upright portions 41 up to an upper portion of the backrest portion. The back support pillar 5 has a forwardly bent portion adjacent the upper end thereof, the bent portion being attached at its leading end with a curved and horizontally extending upper frame 50 having opposite ends each attached with an elastic piece 8 serving as an elastic member.

The elastic pieces 8 attached to the opposite ends of the upper frame 50 are constructed of a synthetic resin or the like and are each formed into a substantially vertically elongate shape. Each elastic piece 8 is fixed on its upper end side to the upper frame 50 and has a free end forming the other end positioned facing opposite to the corresponding upright portion 41. Like the upright portions 41, the elastic pieces 8 each have a lower end portion forming the free end which is curved rearwardly of the backrest portion to form a curved portion 8*c*, while the plane extending tangential to the fixed end of each elastic piece 8 is oriented forwardly of the backrest portion.

Reference numeral 7 designates the upholstery member extending along the upper surfaces of the elastic pieces 8 and upright portions 41, the upholstery member 7 being formed of, for example, thin cloth of a cotton material, hemp material or the like. The upholstery member 7 is fixed to the bent portions 41*a* of the upright portions 41 on its lower edge side and to the upper ends of the elastic pieces 8 on its upper edge side in a stretched fashion so as not to wrinkle. When the upholstery member 7 is attached to the chair 1, the whole backrest portion takes a forwardly curved form.

Figure 3:
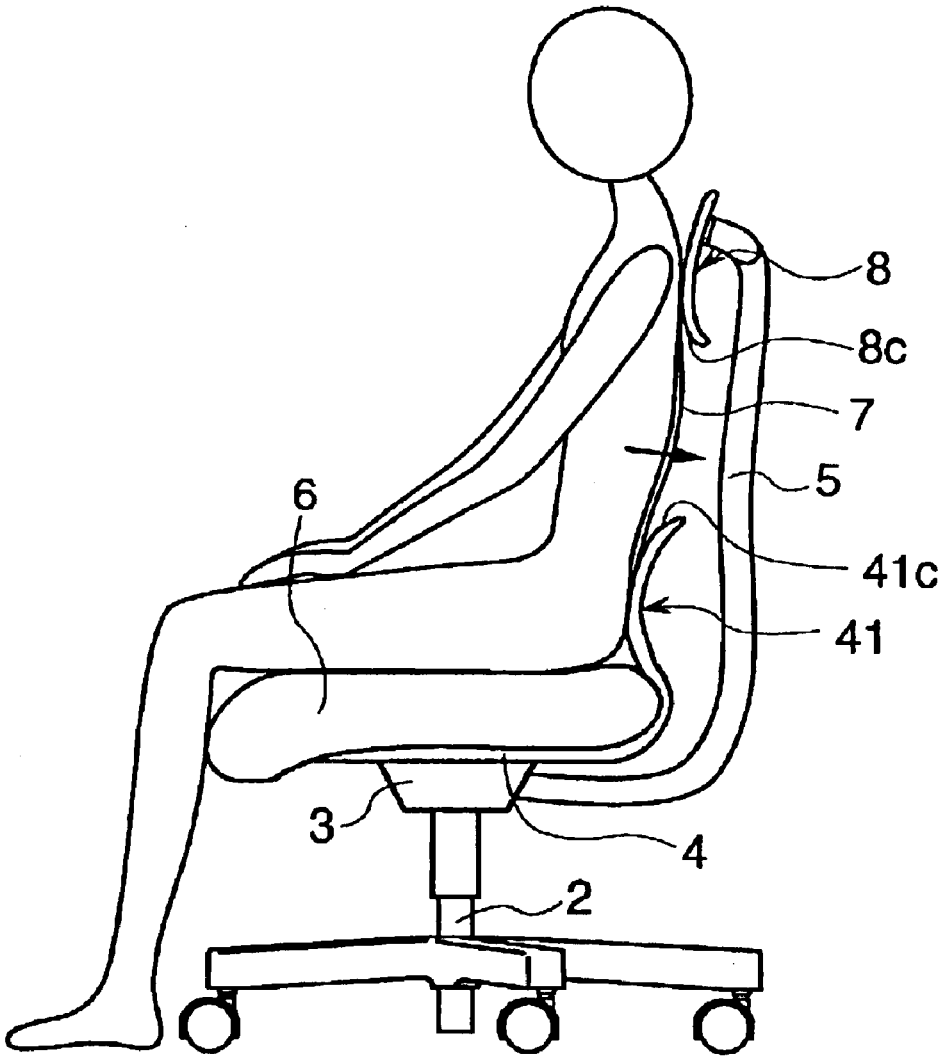
FIG. 3 is a side view of the same embodiment in a state where a person is sitting thereon.

FIG. 3 illustrates the chair 1 thus constructed in a state where a person is sitting thereon. When the sitting person leans against the backrest portion with his or her back contacting a generally central portion of the upholstery member 7, the upholstery member 7 deforms in a manner to align with the curved portions 41*c* and 8*c* located on the free end sides of the elastic pieces 8 and upright portions 41. At the same time therewith, the upholstery member 7 depresses the elastic pieces 8 and the upright portions 41 rearwardly, so that the elastic pieces 8 and the upright portions 41 are deflected rearwardly in a cantilevered fashion. Thus, the elastic force can be smoothly reduced from the fixed ends of the elastic pieces 8 and upright portions 41 toward their free ends thereby imparting the backrest portion with smooth elasticity. Further, as the central portion of the backrest portion deflects rearwardly when the sitting person leans against the backrest portion, the head of the sitting person can be inclined forwardly about the upper frame 50 serving as a fulcrum, whereby the eyes of the sitting person can be directed at the upper side of a desk.

Figure 4:
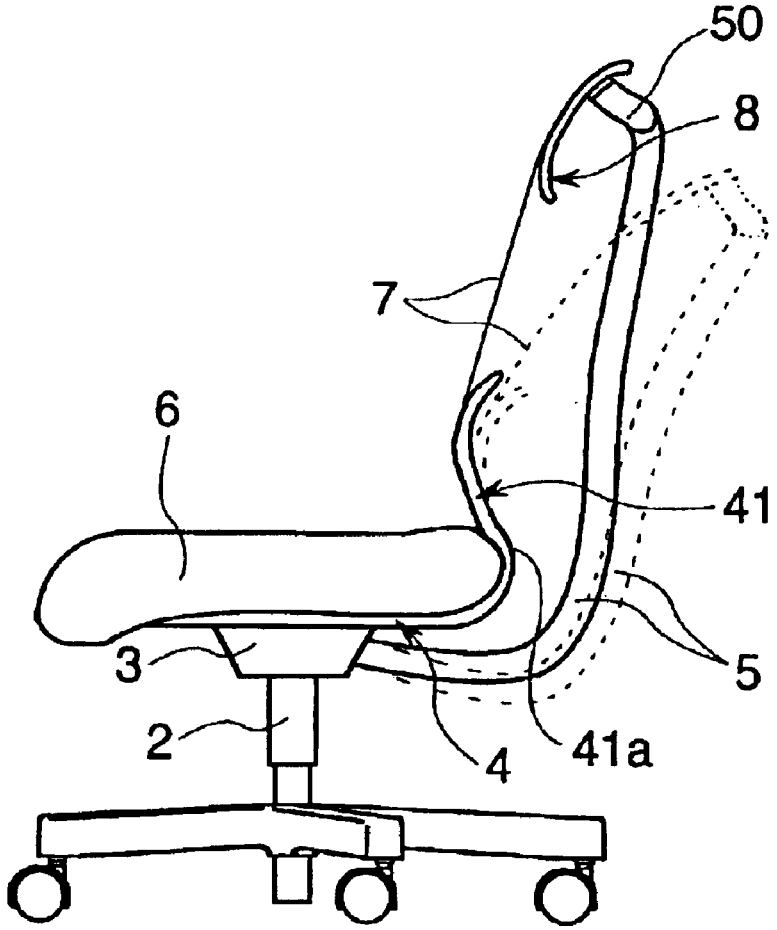
FIG. 4 is a side view of the same embodiment in a state where the backrest portion is inclined rearwardly.

Next, the chair 1 thus constructed assuming a state where the backrest portion is inclined rearwardly is described with reference to FIG. 4. When the sitting person causes the back support pillar 5 to incline rearwardly by operating a lever (not shown) provided on the underside of the seat plate 4 or the like, the distance between each bent portion 41*a* defining the rear end of the seat plate 4 and the upper frame 50 varies. In response, the tension of the upholstery member 7 varies corresponding to a varied length of the distance, and the upright portions 41 and the elastic pieces 8 vary their deflecting amounts to accommodate to the variation in tension thereby eliminating wrinkles of the upholstery member 7.

Since the chair having the upholstery member 7 mounted on the backrest according to this embodiment is of the construction having the elastic pieces 8 and upright portions 41 allowing their deflection in the direction in which the load of the sitting person works and the upholstery member 7 mounted over the elastic pieces 8 and upright portions 41, the upholstery member 7 is imparted with an elastic force by restoring forces of the elastic pieces 8 and upright portions 41 against their deflection even when the elastic force developed by the upholstery member 7 itself is small, thereby making the sitting comfort better. Further, when the sitting person leans against the chair 1, the central portion of the backrest portion deforms rearwardly thereby making it possible to incline the shoulder portion or the head of the sitting person forwardly about the upper frame 50 serving as a fulcrum as shown in FIG. 3, hence, to direct the eyes of the sitting person at the upper side of a desk or the like. Still further, since the leaf-like elastic members constructed as the elastic pieces 8 and upright portions 41 work like leaf springs, there is no need to secure a space that would be required if coil springs are used, while at the same time the elastic members if combined with a planar member such as the upholstery member are capable of smoothing the surface of such a planar member, ensuring a higher degree of design freedom.

Though the upright portions 41 serving as elastic members extend from the rear edge side of the seat plate 40 in this embodiment, the present invention is not limited to this structure and it is possible that a lower frame is attached to a lower portion of the back support pillar 5 so as to extend horizontally and elastic members are secured to this frame. In such a case, it is possible that a pair of right and left back support pillars are provided instead of the provision of only one back support pillar 5 required by this embodiment and elastic members are secured to the upper and lower ends of each back support pillar 5. Such elastic members may be secured with their respective fixed ends positioned away from each other and with their respective free end portions largely curved and facing each other.

Though the lower end of each elastic piece 8 and the upper end of each upright portion 41 are made free in this embodiment, the present invention is not limited to this structure and it is possible that each elastic member is provided having right or left end made free.

As a variation of this embodiment, it is possible to provide elastic members positioned partially overlapping each other. As a manner to attach the upholstery member to the chair, it is possible that the upholstery member in a state embracing the elastic members is attached to the frame.

Further, though the case where the backrest portion is fitted with the elastic members is described in this embodiment, the present invention is not limited to this case and it is possible to provide the seat portion with such elastic members.

(Second Embodiment)

Figure 5:
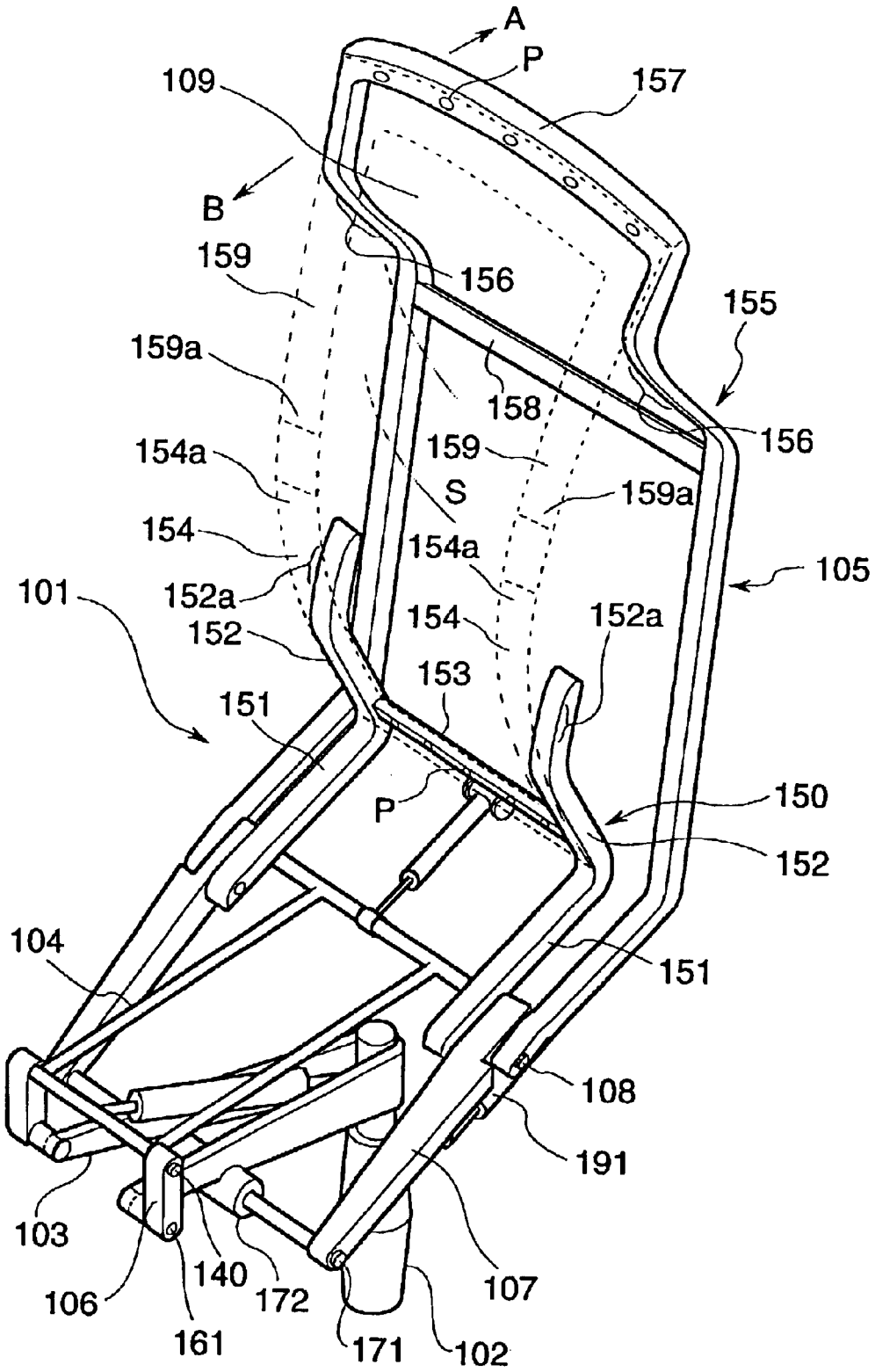
FIG. 5 is a perspective view showing a principal portion of a chair according to a second embodiment of the present invention.

Next, the second embodiment of the present invention is described with reference to the drawings. FIG. 5 is a perspective view showing a principal portion of a chair 101 according to one embodiment of the present invention. The chair 101 mainly comprises a support base 103 mounted on a base leg 102, links 106 and 107 attached to the support base 103, seat frames 104 attached to the links 106 and 107, and backrest frames 105 located rearwardly of the seat frames 104. The chair 101 is configured to allow mounting of a gas cylinder for imparting the seat frames 104 and backrest frames 105 with elastic forces and of other members such as a cover and cushion.

The support base 103 is constructed of an aluminum member or the like shaped into an inverted triangle and has a lower end attached to the base leg 102 and a front end portion fitted with each link 106 through a shaft 161. The link 106 is configured to be rotatably movable by means of a shaft 140 attached to the front end of the seat frames 104 and the shafts 161 attached to the support base 103. Each link 107 has one end fixed to a shaft 171 of a torsion bar 172 located at a substantially central portion of the inclined side of the support base 103 and the other end rotatably attached to a rear end portion of the seat frames 104. The torsion bar 172 is provided to impart the shaft 171 with a rotational power, and the force of this spring constantly biases the links 107 so that the shaft 108 side of each link 107 rotates forwardly of the chair 1 (toward the side B).

On the underside of an upper end portion of each link 107 is provided a gas spring 191 connected to each backrest upper frame 155, the gas spring 191 constantly biasing each backrest frame 105 forwardly (toward the side B) by means of its gas pressure. The gas spring 191 is provided with a mechanism for pinching and fixing a spring shaft and hence can be switched between a free state and a fixed state when a lever not shown is operated.

The shafts 108 on the upper end side of the links 107 are attached to backrest lower frames 150 and the backrest upper frames 155 for their rotation. The backrest lower frames 150 include ischium-corresponding frames 151 each extending substantially on an extension line of the corresponding link 107, hipbone-corresponding frames 152 each extending as bent from the corresponding ischium-corresponding frame 151 and as inclined upwardly or in the direction B, and a connection member 153 interconnecting the hipbone-corresponding frames 152. Further, a curved portion 152*a* is provided in an upper end portion of each of the two hipbone-corresponding frames 152 so as to serve as an escape portion extending away from the fixed end side of an elastic member 154 in a manner to draw an arc in the direction in which the load imposed by the sitting person works (in the direction A), thereby defining an escape space S for the elastic member 154.

The elastic member 154 is attached in a manner to extend from the connection member 153 to a location just short of the curved portion 152*a* of each hipbone-corresponding frame 152 and is constructed of a thin synthetic resin material of a substantially U-shape opening upward or a like material. The elastic member 154 is fixed together with an upholstery member 109 to the hipbone-corresponding frames 152 and connection member 153 by means screws P. Further, free ends 154*a* of the elastic member 154 are positioned on the hipbone-corresponding frames 152 when the elastic member 154 is in a state not attached with the upholstery member 109, so that the upholstery member 109 is pressed outwardly from the inside by the restoring counterforce of the elastic member 154. The substantially U-shaped elastic member 154 inwardly protrudes from the right and left hipbone-corresponding frames 152 and has an additional free end above the connection member 153, thereby imparting a cushion property to the inside defined by the substantially U-shape.

Each of the backrest upper frames 155 attached to the shafts 108 has a lower portion bent upwardly like each backrest lower frame 150 and extends behind the backrest lower frames 150 up to a level adjacent the shoulders of the sitting person. On the upper end side of each backrest upper frame 155 is provided a curved portion 156 serving as an escape portion arcuately curved toward a direction allowing deflection of the free end 159*a* side of the elastic member 159 to define an escape space S between the elastic member 159 and the curved portion 156. Further, on the lower end sides of the right and left curved portions 156 is provided a connection member 158 interconnecting the right and left frames for reinforcement, while on the upper end side of the curved portions 156 is also provided a connection member 157. The connection member 157 has a curved central portion adapted to support the shoulder portion of the sitting person in a manner to embrace the shoulder portion.

Like the elastic member 154 located on the lower side, the elastic member 159 attached to the connection member 157 and to the right and left frames is constructed of a thin resin plate formed into a substantially inverted U-shape and has an upper end side fixed to the connection member 157 together with the upholstery member 109 by means of screws P and a free end 159*a* side allowed to deflect over the curved portions 156. Further, the inside of the right and left frames and the lower side of the connection member 157 are arranged so that the free end 159*a* side of the elastic member 159 protrudes from the frames, thereby imparting a cushioning property to the inside space defined by the substantially U-shape. Further, the free ends 159*a* of the elastic member 159 are positioned as overlapping the free ends 154*a* of the opposite elastic member 154. Accordingly, even when only the upper portion of the backrest portion is inclined rearwardly, the free ends 159*a* of the elastic member 159 press the free ends 154*a* of the opposite elastic member 154 rearwardly, with the result that the upper and lower elastic members 154 and 159, as a whole, defines a stepless deflection curve.

Reference numeral 109 designates the upholstery member placed over these elastic members 154 and 159 which is constructed of, for example, a nylon member provided with mesh. The upholstery member 109 is attached to the backrest upper frames 155 and to the backrest lower frames 150 so as to cover the elastic members 154 and 159. For example, the upholstery member 109 is integrated with the elastic members 154 and 159 by embracing them therein and is fixed to the frames by means of screws P.

Figure 6:
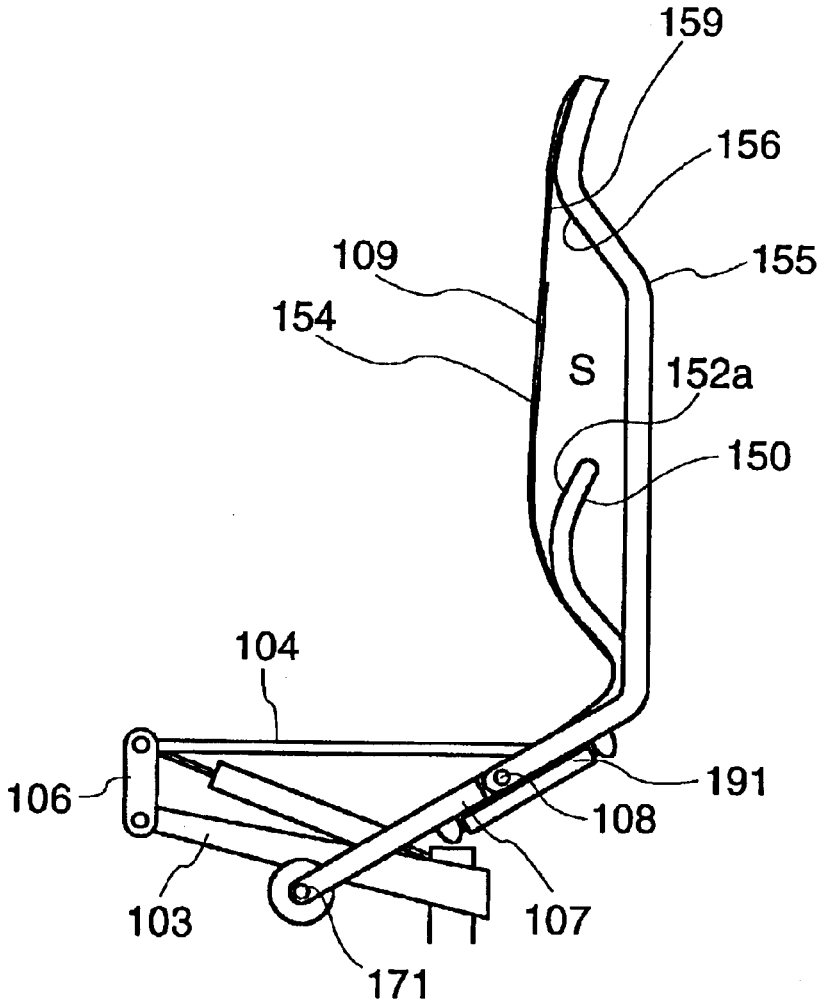
FIG. 6 is a side view of the principal portion of the same embodiment.
Figure 7:
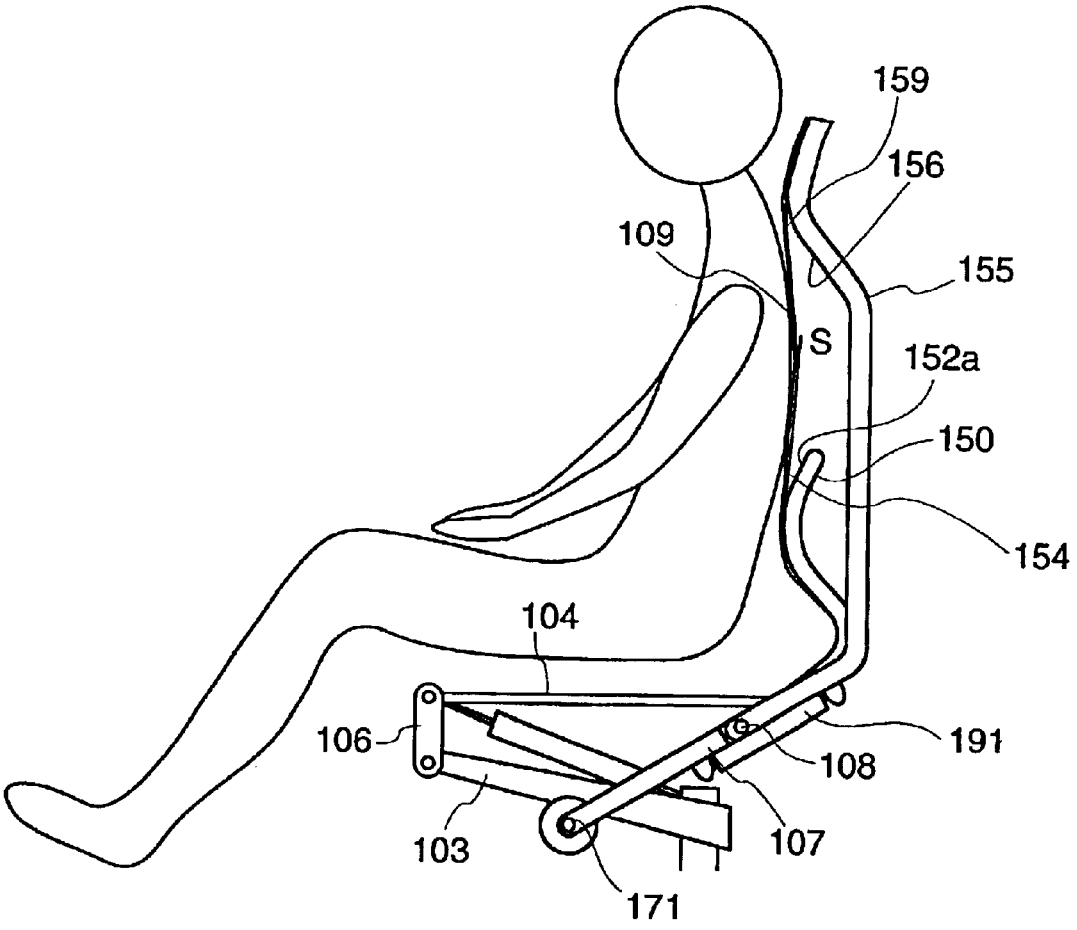
FIG. 7 is a view showing the principal portion shown in FIG. 6 in a state a person is sitting on the chair in an upright position.
Figure 8:
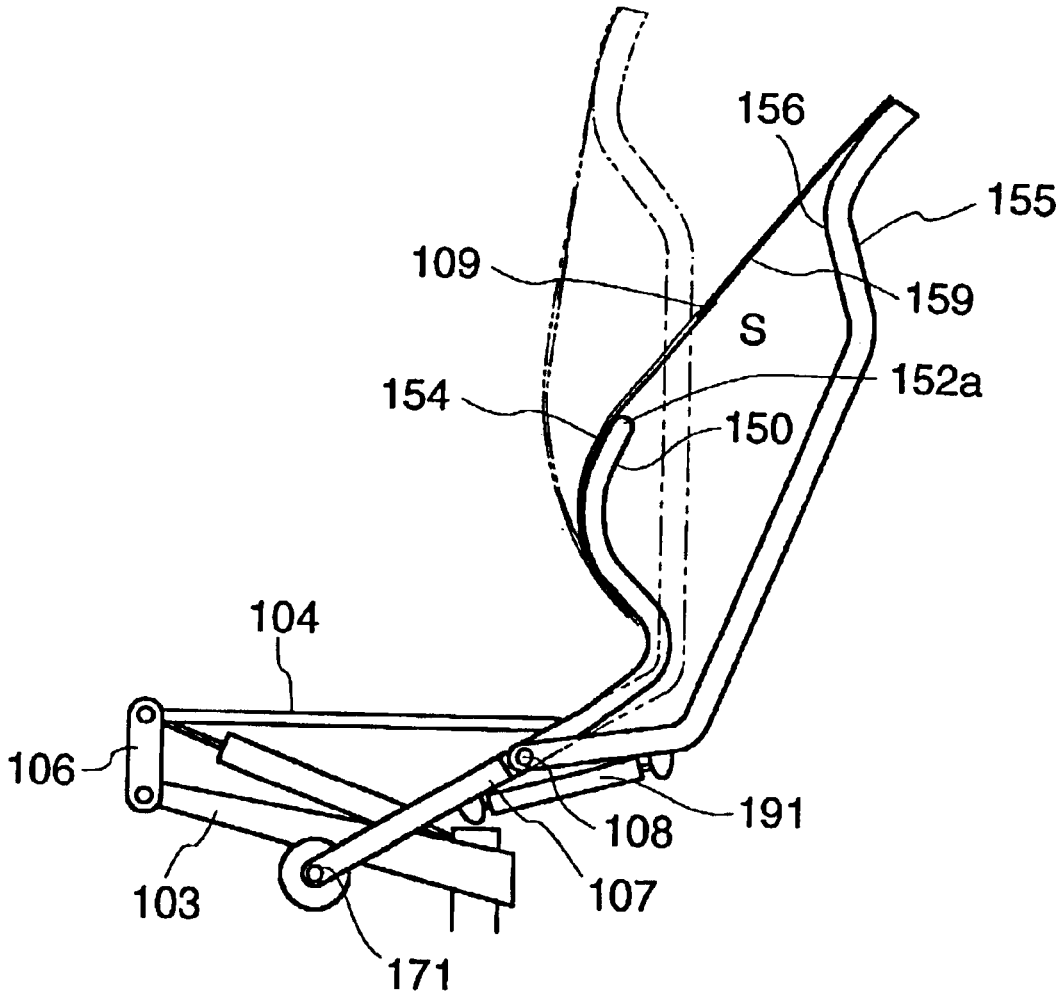
FIG. 8 is a view showing a state of the same embodiment where only the upper frame of the backrest portion is inclined rearwardly.

By thus arranging the backrest frames 105 and the elastic members 154 and 159, the upholstery member 109 becomes pressed from the inside by the elastic members 154 and 159 when it is attached to the backrest as shown in FIG. 6, whereby the cushioning property of the backrest portion can be improved. Further, even when the elastic members 154 and 159 largely deflect when a person sits on the chair (refer to FIG. 7), the elastic members 154 and 159 deflect along the curved portions 152*a* and 156, so that the sitting person is not given a localized uncomfortable feeling by the backrest portion. Alternatively, even when only the backrest upper frames 155 of the chair 101 thus constructed are inclined rearwardly, that is, even when the backrest upper frames 155 are rotated about the shafts 108 by making the gas springs 191 free with the seat frames 104 fixed (refer to FIG. 8), the elastic member 154 can absorb a variation in the length of the upholstery member 109 while deflecting along the curved portions 152*a*, thereby making it possible to smooth the surface of the backrest portion.

Since the chair 101 fitted with the upholstery member 109 in the human body contacting portion includes the backrest upper frames 155 and backrest lower frames 150 provided with the curved portions 156 and 152*a* and the upholstery member 109 covering the curved portions, the upholstery member 109 can be caused to smoothly align with these curved portions 156 and 152*a* when a load is imposed on the upholstery member 109.

Further, the chair is fitted with the elastic members 154 and 159 each having free end 154*a* or 159*a* on one side and fixed end on the other side and defines the escape space S that extends in the direction in which the elastic members 154 and 159 deflects (in the direction A) and is gradually widened from the fixed end sides toward the free ends 154*a* and 159*a*. This feature enables the elastic members 154 and 159 to deform along the escape space S even if the elastic members 154 and 159 are largely deflectable, thereby lessening uncomfortable feeling given by a human body contacting portion.

Further, since this embodiment is provided with the frames having curved portions 154*a* and 156 under the elastic members 154 and 159 which are curved along deflections of the elastic members 154 and 159, the elastic members 154 and 159 are capable of aligning with the curved portions 154*a* and 156 even when the elastic members 154 and 159 largely deflect, whereby the human body contacting portion can be imparted with smooth touch, while at the same time the elastic members 154 and 159 and the upholstery member 109 can be prevented from deteriorating due to their deflection.

Though the backrest portion of the chair 101 is described in this embodiment, the seat portion of the chair 101 may be constructed similarly to the backrest portion. In this case, the chair offers a sitting comfort like a sofa because its seat portion is largely deflectable.

Further, though the curved portions are formed of frames in this embodiment, the present invention is not limited to this feature and the curved portions may be formed of other members than the frames, for example, rubber members having cushioning property. With this construction, when the elastic members 154 and 159 largely deflect, the elastic members 154 and 159 first contact the curved portions and then press against the rubber members, whereby a sitting person can be given a mitigated feeling of contact.

INDUSTRIAL APPLICABILITY

As has been described, the present invention provides a chair fitted with an upholstery member in a portion adapted to contact a human body, wherein an elastic member is provided which allows a deflection in a direction in which a load imposed by the human body contacting the chair works and the upholstery member is mounted over the elastic member. The chair thus constructed can offer a soft sitting comfort by virtue of the elastic force developed by deflection of the elastic member even if the elastic force of the upholstery member is small.

The present invention also provides a chair fitted with an upholstery member disposed in a portion adapted to contact a human body and attached to a frame, wherein the frame is formed with an escape portion which enlarges an area of contact between the upholstery member and the frame from an attached end of the upholstery member when a load is imposed on the upholstery member. The chair thus constructed can prevent the upholstery member from sharply bending, thereby lessening uncomfortable feeling of contact.

What is claimed is:

1. A chair fitted with an upholstery member in a portion adapted to contact a human body, wherein:

an elastic member is provided which allows a deflection in a direction in which a load imposed by the human body contacting the chair works; the upholstery member is mounted over the elastic member; and an area of contact between the elastic member and the upholstery member enlarges with an increase of the load imposed on the upholstery member by the human body contacting the chair.

2. The chair according to claim 1, wherein the elastic member is attached in a manner to press the upholstery member toward the side adapted for contacting the human body.

3. The chair according to claim 1 wherein the elastic member is a leaf spring.

4. The chair according to claim 1, wherein the portion adapted to contact the human body is a backrest portion.

5. The chair according to claim 4, wherein the elastic member is attached in a manner to press the upholstery member toward the side adapted for contacting the human body.

6. The chair according to claim 1, wherein the elastic member has a fixed end side and a free end side.

7. The chair according to claim 6, wherein the portion adapted to contact the human body is a backrest portion.

8. The chair according to claim 6, wherein the elastic member is attached in a manner to press the upholstery member toward the side adapted for contacting the human body.

9. The chair according to claim 6 wherein the elastic member is a leaf spring.

10. The chair according to claim 6, wherein the free end side of the elastic member is curved toward the direction in which the load imposed by a sitting person works to form a curved portion, the upholstery member becomes aligned with the curved portion of the elastic member when the upholstery member is deflected.

11. The chair according to claim 10, wherein the elastic member is attached in a manner to press the upholstery member toward the side adapted for contacting the human body.

12. A chair capable of inclining an upper portion of a backrest portion rearwardly relative to a lower portion of the backrest portion, wherein:

a plurality of leaf springs spaced apart from each other are provided between the upper portion and the lower portion of the backrest portion and an upholstery member covering the upper portion and lower portion of the backrest portion is provided over the leaf springs, each of the leaf springs pressing the upholstery member toward a side contacting a human body.

13. A chair comprising an upholstery member disposed in a portion adapted to contact a human body and a frame having a supporting face for supporting the upholstery member from the opposite side of the side contacting the human body, wherein: an attached end of the upholstery member is mounted on the supporting face of the frame, a part of the supporting face forms an escape portion which can keep the part of the supporting face away from the upholstery member, and an area of contact between the upholstery member and the frame enlarges from an attached end of the upholstery member when a load is imposed on the upholstery member to align the upholstery member with the escape portion.

14. The chair according to claim 13 wherein the elastic member is a leaf spring.

15. A chair comprising a frame, an elastic member mounted on the frame with its one end side made free and its other end side fixed and an upholstery member disposed in a portion adapted to contact a human body and placed over the elastic member; wherein an escape space is provided between the elastic member and the frame on a side allowing deflection of the elastic member, the escape space being widened from the fixed end side to the free end side of the elastic member, and an area of contact between the elastic member and the frame enlarges with increase of a load imposed on the upholstery member by the human body contacting the chair.

16. The chair according to claim 15, wherein the escape space is a space defined by the elastic member and a frame having a curved portion aligning with deflection of the elastic member.

17. The chair according to claim 15 wherein the elastic member is a leaf spring.

* * * * *